US008185002B2

(12) United States Patent
Takahashi

(10) Patent No.: US 8,185,002 B2
(45) Date of Patent: May 22, 2012

(54) IMAGE FORMING APPARATUS INCLUDING BELT SURFACE STATE DETECTION

(75) Inventor: Osamu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1135 days.

(21) Appl. No.: 11/645,038

(22) Filed: Dec. 26, 2006

(65) Prior Publication Data

US 2007/0147863 A1 Jun. 28, 2007

(30) Foreign Application Priority Data

Dec. 27, 2005 (JP) ..... 2005-374777

(51) Int. Cl.
*G03G 15/00* (2006.01)

(52) U.S. Cl. ..... 399/49; 399/71; 399/72; 399/99; 399/101; 399/301; 399/302; 399/303; 399/343; 399/344; 399/345; 399/357

(58) Field of Classification Search ..... 399/49, 399/71–72, 99, 101, 301–303, 343–345, 399/357

See application file for complete search history.

(56) References Cited

U.S. PATENT DOCUMENTS 5,220,391 A * 6/1993 Tange ..... 399/349
5,493,383 A * 2/1996 Pozniakas et al. ..... 399/345
5,652,948 A * 7/1997 Sakaguchi et al. ..... 399/66
5,983,050 A * 11/1999 Takekoshi et al. ..... 399/71
5,991,561 A * 11/1999 Okamoto et al. ..... 399/66
6,026,172 A * 2/2000 Lewis et al. ..... 382/106
6,192,207 B1 * 2/2001 Yamamoto et al. ..... 399/82
6,215,973 B1 * 4/2001 Shin ..... 399/249
6,301,023 B1 10/2001 Hirai et al.
6,321,052 B1 * 11/2001 Yamashina et al. ..... 399/165
6,839,531 B2 * 1/2005 Saitoh et al. ..... 399/167
6,920,291 B2 * 7/2005 Saitoh et al. ..... 399/49
7,546,073 B2 * 6/2009 Saeki et al. ..... 399/302
7,720,400 B2 * 5/2010 Taguchi et al. ..... 399/49
7,819,059 B2 * 10/2010 Mori ..... 101/425
7,831,161 B2 * 11/2010 Hirayama et al. ..... 399/49
7,899,355 B2 * 3/2011 Sakuma ..... 399/101
8,005,385 B2 * 8/2011 Gross et al. ..... 399/60
8,035,859 B2 * 10/2011 Kusunoki ..... 358/3.01

(Continued)

FOREIGN PATENT DOCUMENTS

JP A 63-71876 4/1988

(Continued)

OTHER PUBLICATIONS

Notification of Reasons for Refusal issued in Japanese Patent Application No. 2005-374777; mailed Jun. 22, 2010; with English-language translation.

*Primary Examiner* — David Gray
*Assistant Examiner* — Geoffrey Evans
(74) *Attorney, Agent, or Firm* — Oliff & Berridge, PLC

(57) ABSTRACT

An image forming apparatus includes; an image forming unit; an annular belt that moves circularly; a detection unit that detects a state of a surface of the belt; and a tension increase unit that increases a tension of the belt, at a detection position by the detection unit, when detection is performed by the detection unit, as compared with the tension of the belt before detection at the detection position is performed by the detection unit.

10 Claims, 9 Drawing Sheets

U.S. PATENT DOCUMENTS

| | | | | |
|---|---|---|---|---|
| 8,036,551 | B2 * | 10/2011 | Murayama | 399/49 |
| 8,036,582 | B2 * | 10/2011 | Murata et al. | 399/302 |
| 8,041,274 | B2 * | 10/2011 | Aoki | 399/301 |
| 2003/0039496 | A1 * | 2/2003 | Miyamoto et al. | 399/384 |
| 2004/0264988 | A1 * | 12/2004 | Konishi | 399/49 |
| 2005/0053389 | A1 * | 3/2005 | Tanaka et al. | 399/66 |
| 2005/0141920 | A1 * | 6/2005 | Sato et al. | 399/167 |
| 2005/0226643 | A1 * | 10/2005 | Saitoh et al. | 399/49 |
| 2005/0271429 | A1 * | 12/2005 | Tachibana et al. | 399/301 |
| 2006/0181593 | A1 * | 8/2006 | Okano | 347/112 |
| 2006/0228129 | A1 * | 10/2006 | Yamada | 399/101 |
| 2006/0285872 | A1 * | 12/2006 | Fukuta et al. | 399/99 |
| 2007/0025768 | A1 * | 2/2007 | Komatsu et al. | 399/167 |
| 2007/0147894 | A1 * | 6/2007 | Yokota | 399/165 |
| 2011/0097105 | A1 * | 4/2011 | You et al. | 399/101 |
| 2011/0142484 | A1 * | 6/2011 | Sakuma | 399/99 |
| 2011/0249278 | A1 * | 10/2011 | Yamazaki | 358/1.2 |

FOREIGN PATENT DOCUMENTS

| | | |
|---|---|---|
| JP | A 4-134390 | 5/1992 |
| JP | A 7-77856 | 3/1995 |
| JP | A 7-306602 | 11/1995 |
| JP | A 10-78690 | 3/1998 |
| JP | A 11-220586 | 8/1999 |
| JP | A 2003-337517 | 11/2003 |
| JP | A 2004-361775 | 12/2004 |
| JP | A 2005-91613 | 4/2005 |
| JP | A 2005-148302 | 6/2005 |

* cited by examiner

IMAGE FORMING APPARATUS INCLUDING BELT SURFACE STATE DETECTION

CROSS-REFERENCE TO THE RELATED APPLICATION

This application is based upon and claims priority from prior Japanese Patent Application No. 2005-374777 filed on Dec. 27, 2005, the entire contents of which are incorporated herein by reference.

TECHNICAL FIELD

The present invention relates to an image forming apparatus.

BACKGROUND

Conventionally, a technique for detecting the surface state of a belt has been offered in the field of the image forming apparatus. For example, a technique for reading a pattern image formed on the belt using a sensor was disclosed in JP-A-11-220586. In the conventional image forming apparatus, the information obtained by such reading is utilized for various kinds of control.

SUMMARY

To detect the surface state of the belt at high precision, it is desirable to keep the belt in a stable state at the detection position. Therefore, with the technique of JP-A-11-220586, a rear face contact member for stabilizing the belt planarly is provided near an area for reading the pattern image. With this configuration, the surface state of the belt can be detected at high precision because the stable state is realized near the reading area. However, like the configuration as disclosed in JP-A-11-220586, where the tension is always strengthened in a predetermined area, a greater load is applied on the belt, possibly causing the belt to be elongated or reformed.

Aspects of the present invention provide a configuration capable of detecting the surface state of the belt at high precision while suppressing a load applied to the belt.

According to an aspect of the present invention, there is provided an image forming apparatus including: an image forming unit; an annular belt that moves circularly; a detection unit that detects a state of a surface of the belt; and a tension increase unit that increases a tension of the belt, at a detection position by the detection unit, when detection is performed by the detection unit, as compared with the tension of the belt before detection at the detection position is performed by the detection unit.

DETAILED DESCRIPTION

Figure 1:
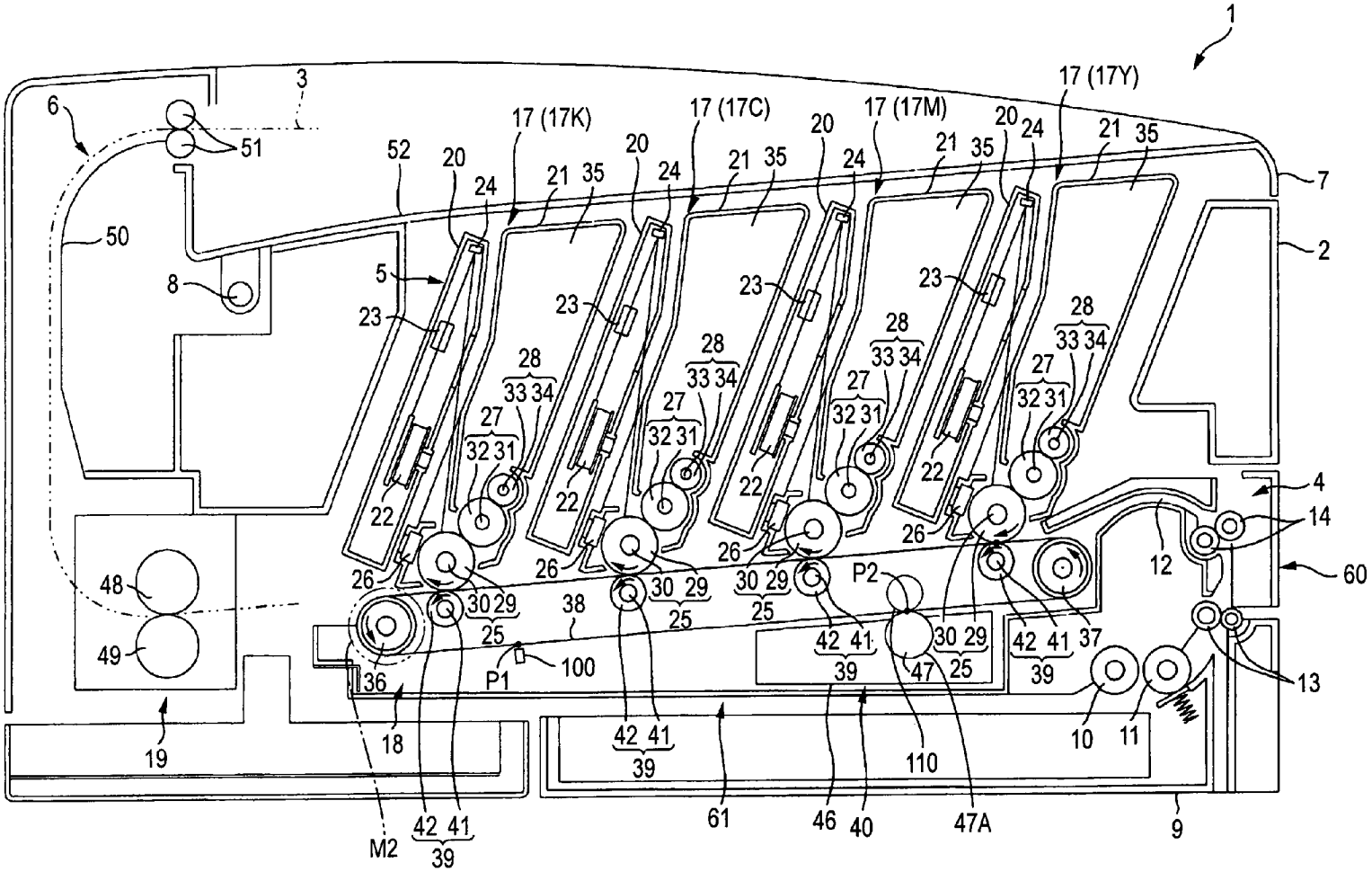
FIG. 1 is a side cross-sectional view schematically showing a color laser printer as an image forming apparatus according to one aspect of the present invention.

FIG. 1 is a side cross-sectional view showing a color laser printer as an image forming apparatus according to one aspect of the present invention.

This color laser printer 1 is the color laser printer of tandem or transversely arranged type in which a plurality of process units 17 are disposed in parallel in the horizontal direction, and includes, within a main body casing 2, a paper feed unit 4 for feeding the paper 3 that is the recording medium, an image forming unit 5 for forming the image on the fed paper 3, and a paper exhausting unit 6 for exhausting the paper 3 on which the image is formed.

The main body casing 2 has a box shape, almost rectangular in side view, in which the upper side is opened, and is provided with a top cover 7 on its top. This top cover 7 is supported rotatably via a cover shaft 8 provided on the rear side of the main body casing 2 (in the following explanation, it is supposed that the left side in FIG. 1 is the rear side and the right side is the fore side), and can be opened or closed on the main body casing 2.

The paper feed unit 4 includes a paper tray 9 provided on the bottom portion of the main body casing 2, a pickup roller 10 and a paper feed roller 11 provided upward on the fore side of the paper tray 9, a paper feed side U-shaped path 12 provided upward at the front of the paper feed roller 11, and a pair of conveying rollers 13 and a pair of registration rollers 14 provided in the middle of the paper feed side U-shaped path 12.

The paper tray 9 can be pulled out, and the sheets of paper 3 are stacked in this paper tray 9. The top paper 3 is picked up by the pickup roller 10, conveyed forward, and fed to the paper feed side U-shaped path 12 by the paper feed roller 11.

The paper feed side U-shaped path 12 is formed as a conveying passage of the paper 3 in the shape of a "U" character, in which its upstream end portion is adjacent to the paper feed roller 11 in the lower portion so that the paper 3 is fed forward, and its downstream end portion is adjacent to a conveying belt 38 in the upper portion, as will be described later, so that the paper 3 is conveyed backward.

And at the upstream end portion of the paper feed side U-shaped path 12, the paper 3 fed forward is conveyed by the conveying rollers 13 in the paper feed side U-shaped path 12 to reverse the conveying direction, registered by the registration rollers 14, and expelled backward by the registration rollers 14.

The image forming unit 5 includes a process unit 17, a transfer unit 18 and a fixing unit 19.

The process unit 17 is provided for each of a plurality of colors of toner. That is, the process unit 17 includes four units, including a yellow process unit 17Y, a magenta process unit 17M, a cyan process unit 17C and a black process unit 17K. The process units 17 are arranged successively in parallel so that they are spaced from each other from the front to the back, and overlapped in the horizontal direction.

Each process unit 17 includes a scanner unit 20 securely disposed in each process unit 17, and a process cartridge 21 removably mounted on each process unit 17.

The scanner unit 20 includes a laser light emitting unit (not shown), a polygon mirror 22, a lens 23 and a reflecting mirror 24. And in the scanner unit 20, a laser beam based on the image data emitted from the laser light emitting unit is reflected from the polygon mirror 22, passed through the lens 23, reflected from the reflecting mirror 24, and directed to a photosensitive drum 25, as will be described later.

Each process cartridge 21 is removably mounted along a direction inclined to the longitudinal direction and the vertical direction (thickness direction of the paper 3), namely, a direction inclined backward from upper to lower side (direction where the upper part is inclined forward), and includes the photosensitive drum 25, a Scorotron type changer unit 26, a developing roller 27 and a supply roller 28.

The photosensitive drum 25 is cylindrical, and includes a drum main body 29 formed of a positively charged photosensitive layer of which the top surface layer is made of polycarbonate, and a drum shaft 30 extending along an axial direction of the drum main body 29 in a shaft center of the drum main body 29. The drum main body 29 is provided rotatably around the drum shaft 30, which is supported on both side walls in the width direction (direction orthogonal to the longitudinal direction and the vertical direction, the same below) of a frame for the process cartridge 21. The photosensitive drum 25 is rotated and driven in the same direction (clockwise direction in the drawing) as the moving direction of the conveying belt 38 at the contact position (image forming position) with the conveying belt 38 in forming the image.

The Scorotron type charger unit 26 is the Scorotron type charger unit of positively charged type that has a wire and a grid, and generates a corona discharge. The Scorotron type charger unit is opposed to the photosensitive drum 25 and located behind the photosensitive drum 25 out of contact.

The developing roller 27 is opposed to the photosensitive drum 25 and disposed above the photosensitive drum 25, and pressed against the photosensitive drum 25. This developing roller 27 has a roller portion 32 of an elastic member made of conductive rubber material covered on a roller shaft 31 made of metal. Also, the roller shaft 31 is supported rotatably on both side walls in the width direction of the process cartridge 21.

The supply roller 28 is opposed to the developing roller 27 and disposed above the developing roller 27, and pressed against the developing roller 27. This supply roller 28 has a roller portion 34 made of conductive sponge material covered on a roller shaft 33 made of metal. Also, the roller shaft 33 is supported on both side walls in the width direction of the process cartridge 21.

Also, an upper portion of the process cartridge 21 is formed as a toner storage chamber 35 for storing the toner, in which the toner of each color is stored. That is, within the toner storage chamber 35, the positively charged, non-magnetic, one component polymerized toner is stored for each process unit 17, such as yellow toner for the yellow process unit 17Y, magenta toner for the magenta process unit 17M, cyan toner for the cyan process unit 17C and black toner for the black process unit 17K.

In each process unit 17, the toner of each color stored in each toner storage chamber 35 is supplied to the supply roller 28 and supplied to the developing roller 27 along with the rotation of the supply roller 28 in the image forming operation. At this time, the toner is positively charged frictionally between the supply roller 28 and the developing roller 27 to which a developing bias is applied.

On the other hand, the Scorotron type charger unit 26 generates a corona discharge by the application of a charging bias to positively charge the surface of the photosensitive drum 25 uniformly. The surface of the photosensitive drum 25 is positively charged uniformly by the Scorotron type charger unit 26 along with the rotation of the photosensitive drum 25, and exposed by fast scanning of laser beam from the scanner unit 20 to form an electrostatic latent image corresponding to the image to be formed on the paper 3.

If the photosensitive drum 25 is further rotated, the positively charged toner carried on the surface of the developing roller 27 confronts and contacts the photosensitive drum 25 along with the rotation of the developing roller 27, and is then supplied to the electrostatic latent image formed on the surface of the photosensitive drum 25, namely, an exposed portion having a lower potential due to exposure to the laser beam on the uniformly, positively charged surface of the photosensitive drum 25. Thereby, the electrostatic latent image on the photosensitive drum 25 is visualized, so that a toner image for each color by reversal development is carried on the surface of the photosensitive drum 25.

The transfer unit 18 is disposed along the longitudinal direction above the paper feed unit 4 and below the process unit 17 within the main body casing 2, and includes a drive roller 36, a tension roller 37, a conveying belt 38, a transfer roller 39 and a belt cleaning unit 40.

The drive roller 36 is rotated and driven in a reverse direction (counterclockwise in the drawing) to the rotation direction of the photosensitive drum 25 by a motor M2 as conceptually shown in FIG. 1, when forming the image.

The tension roller 37 is rotated following the conveying belt in the same direction (counterclockwise in the drawing) as the moving direction of the conveying belt 38 at a contact portion with the conveying belt 38, while the drive roller 36 is rotated and driven.

The conveying belt 38 is an annular belt, and formed of conductive resin such as polycarbonate or polyimide with conductive particles such as carbon dispersed. This conveying belt 38 is wound over the drive roller 36 and the tension roller 37. The tension roller 37 is driven by the driving of the drive roller 36, and the conveying belt 38 is circularly moved between the drive roller 36 and the tension roller 37 to be rotated in the same direction as the photosensitive drum 25 at the image forming position of confronting and contacting the photosensitive drum 25 of each process unit 17. At this time, the drive roller 36 is disposed on the downstream side and the tension roller 37 is disposed on the upstream side in the moving direction of the conveying belt 38 at the contact position with the photosensitive drum 25, thereby pulling an upper portion of the conveying belt 38 opposed to the photosensitive drum 25, and preventing occurrence of a looseness in the upper portion. Therefore, the paper 3 can be conveyed by the conveying belt 38 accurately.

In addition to the drive roller 36, the tension roller 37, and the conveying belt 38, the transfer unit 18, the pickup roller 10, the paper feed roller 11, the rear conveying roller 13, and one pair of registration rollers 14 are integrally held on a belt unit frame 61, thereby constituting a belt unit 60 that can be removed in the horizontal direction from the front side of the main body casing 2.

Also, each transfer roller 39 is opposed via the conveying belt 38 to the photosensitive drum 25 of the corresponding process unit 17 inside the conveying belt 38 wound between the drive roller 36 and the tension roller 37. This transfer roller 39 has a roller shaft 41 made of metal covered with a roller portion 42 of an elastic member made of conductive rubber material. Also, the transfer roller 39 is borne by the bearings (not shown) having conductivity at both ends of the roller shaft 41.

A transfer bias line is electrically connected to each bearing, whereby a transfer bias is applied via the bearing from the transfer bias line to the transfer roller 39 at the time of image forming.

Referring to FIG. 1, the image formation will be described below. The paper 3 fed from the paper feed unit 4 is conveyed from the front to the back by the conveying belt 38 circularly moved by the driving of the drive roller 36, followed by the tension roller 37, to successively pass the image forming position between the conveying belt 38 and the photosensitive drum 25 of each process unit 17, and the toner image of each color carried on the photosensitive drum 25 of each process unit 17 is transferred successively during the conveyance, so that the color image is formed on the paper 3.

That is, the yellow toner image carried on the surface of the photosensitive drum 25 in the yellow process unit 17Y is transferred on the paper 3. Then, the magenta toner image carried on the surface of the photosensitive drum 25 in the magenta process unit 17M is transferred and superposed on the paper 3 where the yellow toner image is already transferred. By the same operation, the cyan toner image carried on the surface of the photosensitive drum 25 in the cyan process unit 17C and the black toner image carried on the surface of the photosensitive drum 25 in the black process unit 17K are transferred and superposed. As a result, the color image is formed on the paper 3.

The belt cleaning unit 40 includes a cleaning box 46 and a cleaning roller 47. The cleaning box 46 is formed with an opening portion in a part on the side opposed to the conveying belt 38, and its inner space is formed as a residual storage unit for storing the adherents removed from the conveying belt 38.

The cleaning roller 47 consists of a roller covered with a cylindrical sponge around the outer circumference of a metallic shaft, and is supported rotatably in an opening portion of the cleaning box 46 to be in contact with an outer face 38*b* on the lower portion of the conveying belt 38. This cleaning roller 47 is driven to apply a force in a direction opposite to the moving direction of the conveying belt 38 on the contact portion with the conveying belt 38 during the cleaning operation. That is, the cleaning roller 47 is rotated and driven by the motor M1 so that a peripheral face 47A in contact with the conveying belt 38 may be moved in a direction opposite to the moving direction of the conveying belt 38 at the contact position with the conveying belt 38. A cleaning bias from a bias line, not shown, is applied to this cleaning roller 47.

In this configuration, the adherents such as the toner adhering to the conveying belt 38 due to contact with the photosensitive drum 25 or the paper powder adhering to the conveying belt 38 due to contact with the paper 3 are captured by the cleaning roller 47, when placed opposite the cleaning roller 47 during the movement of the conveying belt 38. And the captured adherents are scraped away from the cleaning roller 47 within the cleaning box 46, and stored in the residual storage unit within the cleaning box 46.

Moreover, a counter roller 110 is provided to be opposed to the cleaning roller 47 via the conveying belt 38. This counter roller 110 carries the belt together with the cleaning roller 47. In this aspect, the counter roller 110 is supported rotatably at a predetermined position of the frame for the conveying belt 38, to entrain the conveying belt by contact with the conveying belt 38.

The fixing unit 19 is disposed in the rear of the transfer unit 18. This fixing unit 19 includes a heating roller 48 and a pressure roller 49.

The heating roller 48 is a metallic element tube formed with a surface lubricant layer on its surface and internally has a halogen lamp along its axial direction. The surface of the heating roller 48 is heated up to a fixing temperature by the halogen lamp. Also, the pressure roller 49 is provided to press the heating roller 48.

The color image transferred on the paper 3 is then conveyed to the fixing unit 19, and thermally fixed while the paper 3 is passed between the heating roller 48 and the pressure roller 49.

The paper exhausting unit 6 includes a paper exhausting side U-shaped path 50, the paper exhausting rollers 51 and a paper output tray 52.

The paper exhausting side U-shaped path 50 is formed as a conveying path of the paper 3 in the shape of a "U" character, in which its upstream end portion is adjacent to the fixing unit 19 in the lower portion, so that the paper 3 is fed backward, and its downstream end portion is adjacent to the paper output tray 52 in the upper portion, so that the paper 3 is exhausted forward.

One pair of paper exhausting rollers 51 is provided at an end portion on the downstream side of the paper exhausting side U-shaped path 50.

The paper output tray 52 is formed as an inclined wall inclined downward from the front to the back on the upper face of the main body casing 2.

The paper conveyed from the fixing unit 19 is fed backward to the upstream end of the paper exhausting side U-shaped path 50 to reverse the conveying direction within the paper exhausting side U-shaped path 50, and exhausted forward onto the paper output tray 52 by the paper exhausting rollers 51.

The electrical configuration of the laser printer 1 will be described below.

Figure 2:
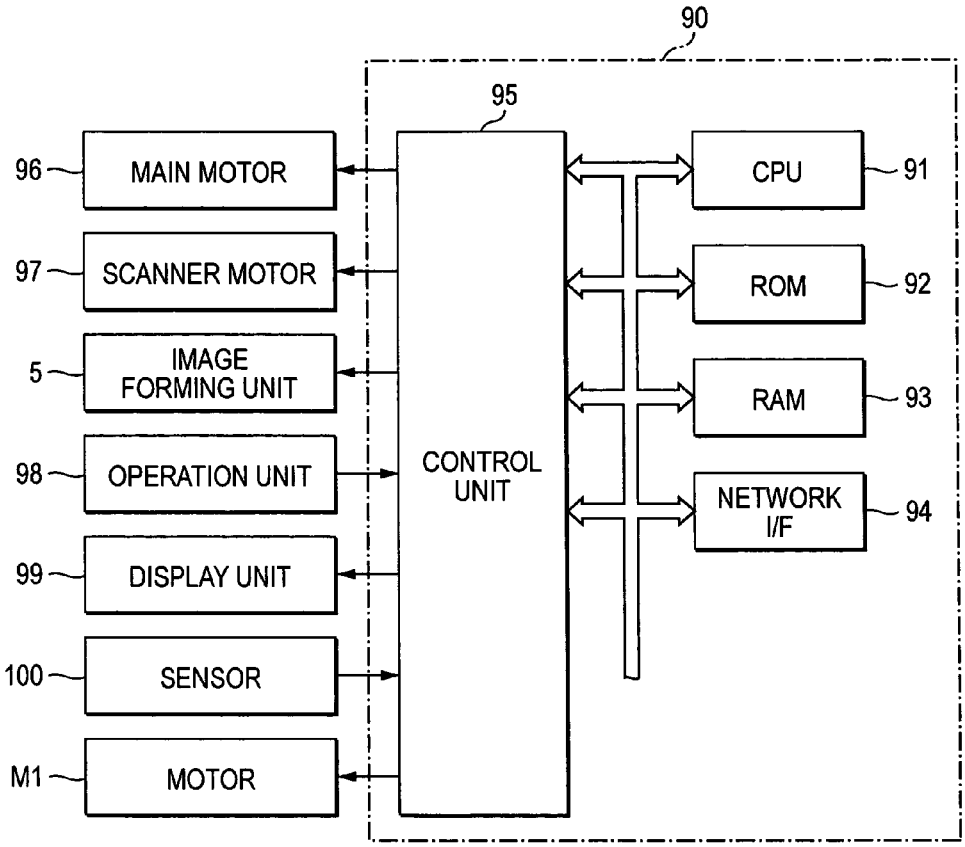
FIG. 2 is an explanatory view illustrating the electrical configuration of the color laser printer as shown in FIG. 1.

FIG. 2 is a block diagram conceptually showing the electrical configuration of the laser printer 1.

The laser printer 1 has a control unit 90 for controlling each component using a control unit 95 including a CPU 91, a ROM 92, a RAM 93, and an ASIC (Application Specific Integrated Circuit) as shown in FIG. 2. Moreover, an operation unit 98 including a main motor 96, a scanner motor 97 and an input panel, a display unit 99 having various kinds of lamps, and a sensor 100 are provided in a form electrically connected to the control unit 95, thereby constituting a control system.

The ROM 92 and the RAM 93 are connected to the CPU 91, which controls each component via the control unit 95 in accordance with a procedure stored in the ROM 92, while storing the processing result in the RAM 93.

The main motor 96 rotates the conveying belt 38. Also, the scanner motor 97 rotates the polygon mirror 22 within the scanner unit 20.

The CPU 91 controls the driving of the main motor 96 and the scanner motor 97 based on a program stored beforehand in the ROM 92.

The control unit 95 controls the image forming unit 5 in accordance with a command from the CPU 91. Specifically, it makes the exposure control for exposing the surface of the photosensitive drum 25 with each part making up the scanner unit 20, and the transfer bias control in transferring the toner onto the paper 3.

Also, the control unit 90 is provided with a network interface (network I/F) 94 for connecting to an external apparatus such as a personal computer.

Figure 3:
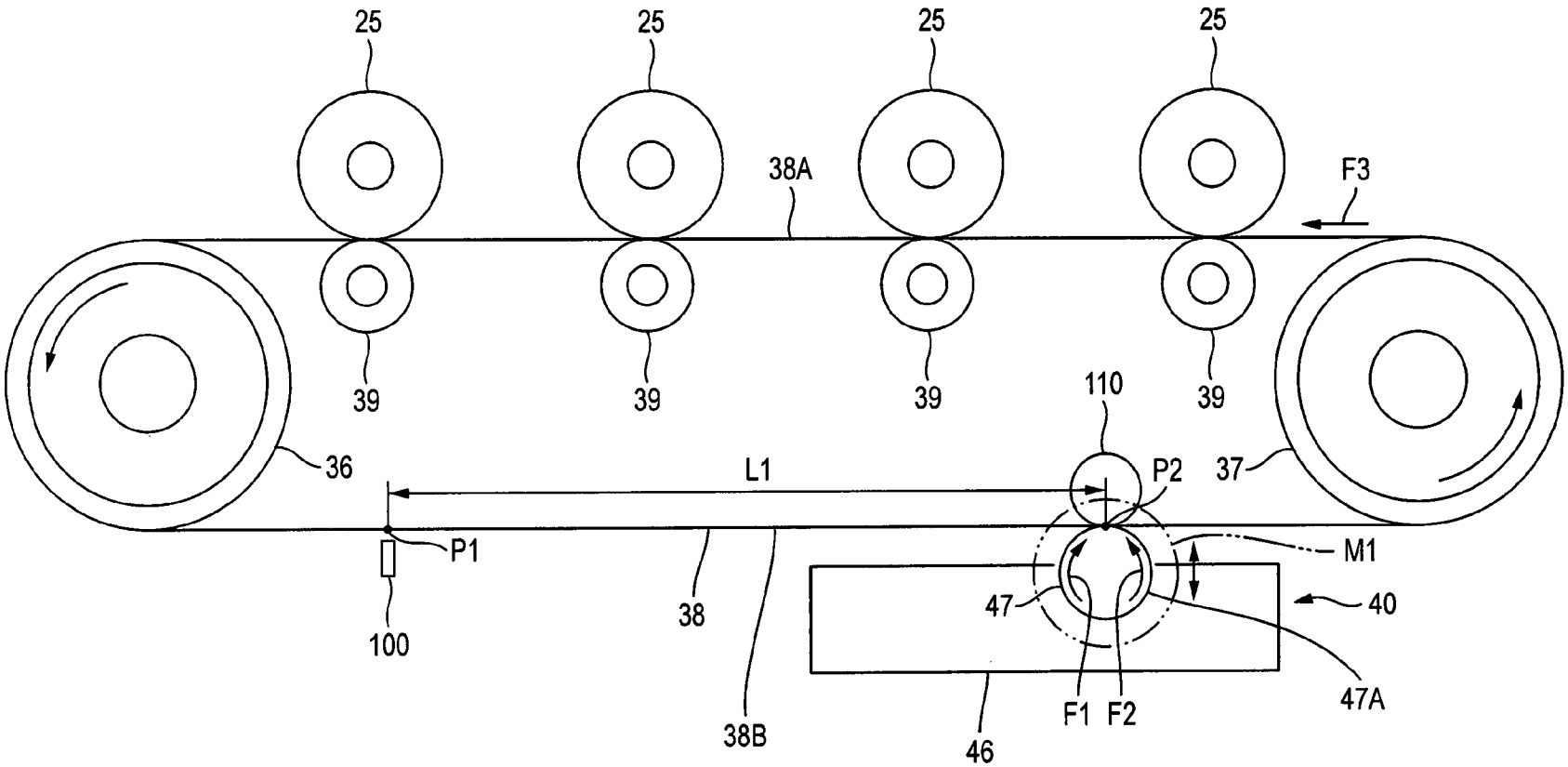
FIG. 3 is an explanatory view for conceptually explaining the configuration near the conveying belt.

The motor M1 consists of a DC motor, for example, and is controlled for the driving by the control unit 95 and a drive circuit, not shown, to be rotatable in both directions (see F1 and F2 in FIG. 3).

The outline of the feature configuration of this aspect will be described below. FIG. 3 is an explanatory view for conceptually explaining the configuration around the conveying belt 38.

As shown in FIGS. 1 and 3, the laser printer 1 is provided with the sensor 100 for sensing the surface state of the conveying belt 38. This sensor 100 (corresponding to a detection unit) is constituted as a concentration detection sensor for sensing the surface darkness (i.e., the amount of reflected light when light is irradiated to the surface) of the conveying belt 38. That is, the conveying belt 38 conveys the paper 3, as described above, but can be moved circularly while directly carrying the pattern image (pattern image such as a concentration patch (see FIG. 6) for use in the calibration process) formed by the image forming unit 5. The sensor 100 can sense the concentration of the pattern image or the darkness of the substrate on the conveying belt 38.

In the laser printer 1, the tension of the conveying belt 38 is increased at a detection position P1 of the sensor 100 (to which the sensor 100 is opposed) as compared with before detection, when the sensor 100 senses the surface darkness of the conveying belt 38. In this aspect, a tension increase unit includes the CPU 91, the motor M1 and the cleaning roller 47. Specifically, when the pattern image is detected by the sensor 100, or when the substrate darkness on the belt is detected by the sensor 100, the tension of the belt at the detection position is increased as compared with before detection. In the following, the control configuration for the image formation, and further the configuration for increasing the tension will be described in detail.

First of all, a normal image forming process will be described below.

Figure 4:
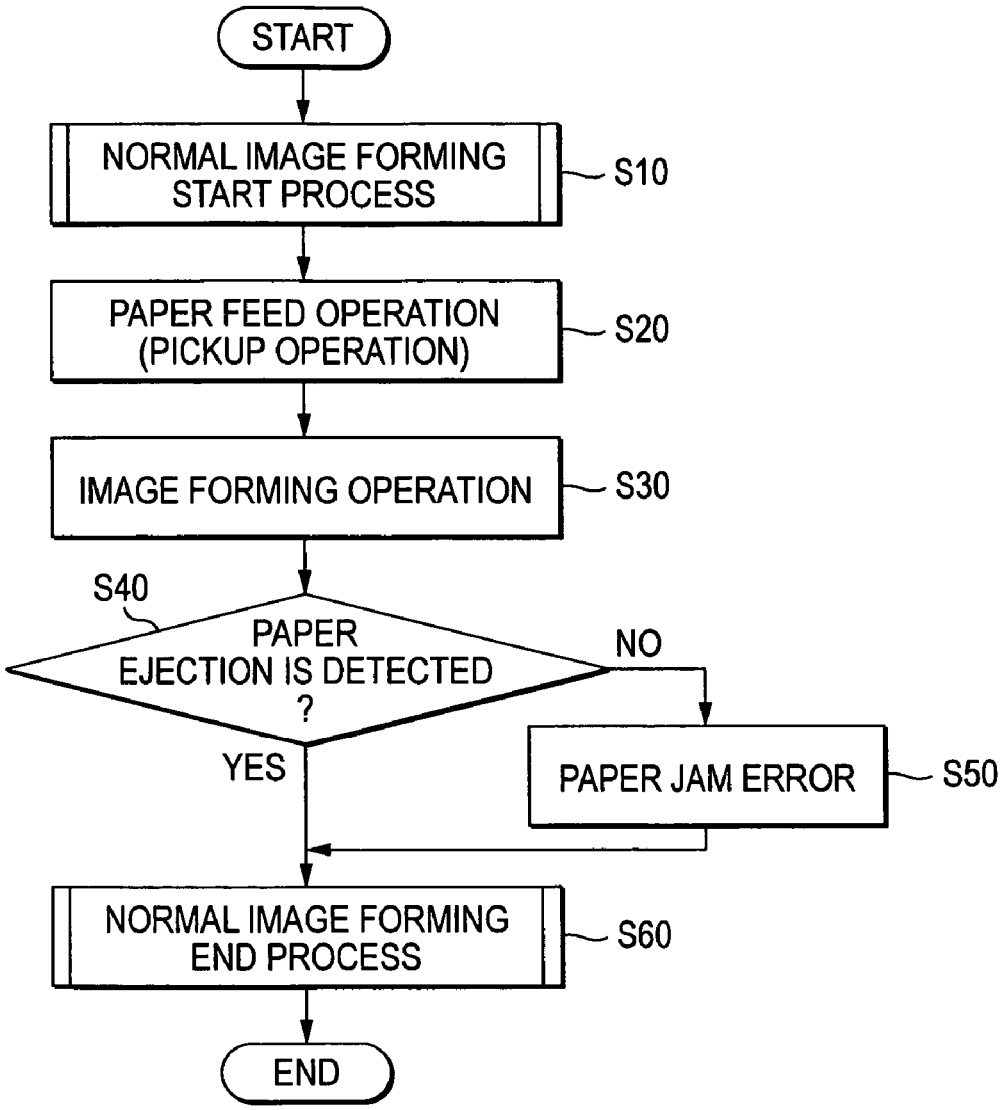
FIG. 4 is a flowchart illustrating the flow of a main routine of a normal image forming process.

As shown in a flowchart of FIG. 4, if the image forming process is executed, a normal image forming start process is performed at S10. This normal image forming start process involves starting to drive the conveying belt 38, the photosensitive drum 25, the developing roller 27, the cleaning roller 47, and the fixing rollers (heating roller 48, pressure roller 49) in the normal rotation direction. The start of driving them may be made in sequence, or in parallel. The normal rotation direction of the conveying belt 38 is the direction of F3 as shown in FIG. 3, and the normal rotation direction of the cleaning roller 47 is the direction (direction of the arrow F1 in FIG. 3) of delivering the conveying belt 38 in the direction of the arrow F3. Also, the normal direction of the photosensitive drum 25 is clockwise (see the arrow in FIG. 1) as shown in FIGS. 1 and 3, and the normal rotation of the developing roller 27 is the opposite direction (i.e., counterclockwise in FIG. 1) to that of the photosensitive drum 25.

The paper feed operation is performed by the paper feed unit 4 at S20. Then, the image forming operation is performed by the image forming unit 5 at S30. Thereafter, if the paper exhausted onto the paper output tray 52 is detected by a sensor, not shown, the operation branches to Yes at S40 to go to a normal image forming end process at S60. On the other hand, if the paper exhausted is not confirmed within a predetermined period, the operation branches to No at S40 to display an error message for paper jam at S50, and then advances to the normal image forming process at S60. This normal image forming end process involves stopping all of the conveying belt 38, the photosensitive drum 25, the developing roller 27, the cleaning roller 47, and the fixing rollers (heating roller 48, pressure roller 49) which start to be driven in the normal image forming start process at S10. They may be stopped in sequence or in parallel.

A patch concentration measurement process will be described below.

Figure 5:
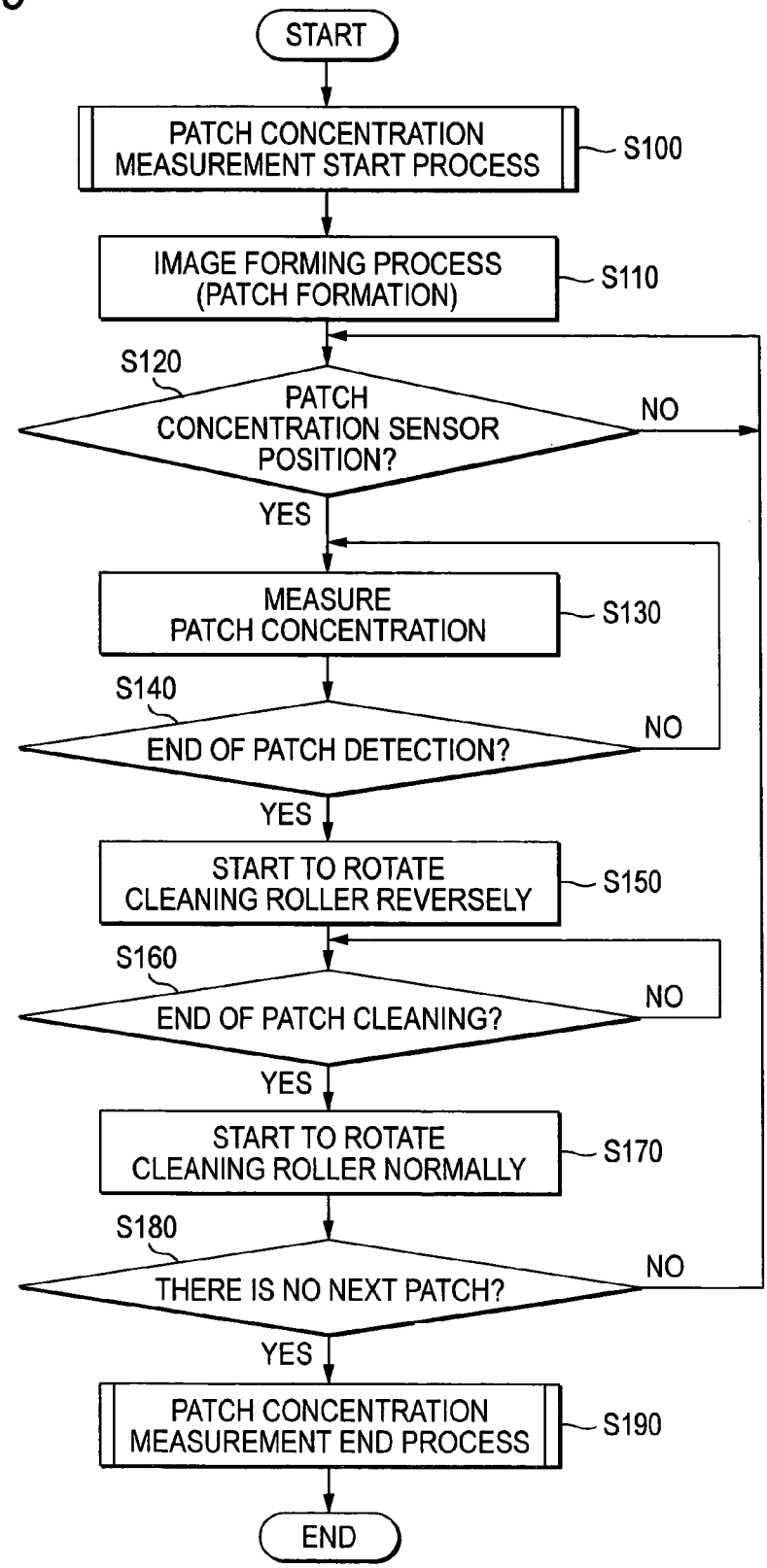
FIG. 5 is a flowchart illustrating the flow of a patch concentration measurement process.

FIG. 5 is a flowchart illustrating the flow of the patch concentration measurement process.

If the patch concentration measurement process is executed, first of all, a patch concentration measurement start process is performed at S100. The patch concentration measurement start process at S100, which is the same as the normal image forming start process at S10 in FIG. 4, involves starting to drive the conveying belt 38, the photosensitive drum 25, the developing roller 27, and the cleaning roller 47 in the normal rotation direction, but the driving of the fixing rollers is not started because the fixing unit is not employed in the patch concentration measurement process.

Figure 6:
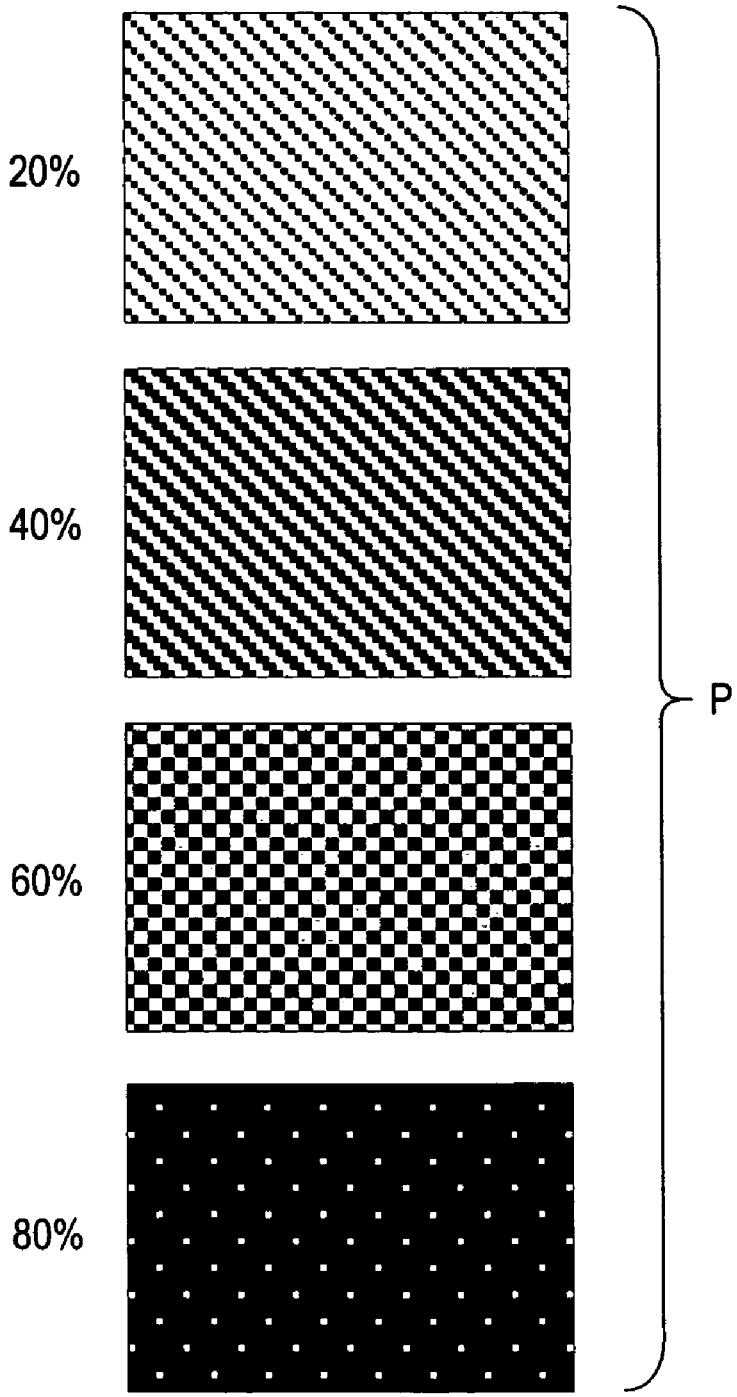
FIG. 6 is an explanatory view illustrating the patch that is one example of the pattern image.

Thereafter, a patch P (corresponding to one example of the pattern image) as illustrated in FIG. 6 is formed on the conveying belt 38 at S110. The patch P as illustrated in this aspect is a mark group in which the mark of any color is aggregated. In FIG. 6, for yellow color, the patch P is constituted by forming the mark at four gradations of 20%, 40%, 60% and 80%. For magenta color, cyan color and black color, not shown, other than yellow color, the patch is constituted by aggregating the mark at multiple gradations.

The example of patch is not limited to the mark group for each color as shown in FIG. 6, but may be the mark group in which the marks of plural colors are aggregated. For example, the marks of plural colors at the same gradation may be aggregated to make up the patch.

The formed patch P (FIG. 6) is moved in a state where it is carried on the conveying belt 38, and moved up to the detection position P1 of the sensor 100 as shown in FIG. 3. The sensor 100 is opposed to the conveying belt 38 between a support position at which the conveying belt 38 is supported by the drive roller 36 and a cleaning position P2 at which the conveying belt 38 is contacted by the cleaning roller 47 in the circulating direction of the conveying belt 38. If the top of the patch P is moved up to the position of the sensor 100, the operation branches to Yes at S120, whereby the sensor 100 measures the concentration of the patch P (S130). While the concentration of the patch P is being detected, the decision at S140 is No, whereby the concentration measurement at S130 is repeated.

In this aspect, after the cleaning roller 47 starts to be driven in the normal direction at S100, the driving in the normal direction is maintained, and the detection is made by the sensor 100 in this state. That is, while the concentration of the patch P is being detected by the sensor 100, the resistance force of the cleaning roller 47 against the circulating movement of the conveying belt 38 is decreased as compared with before detection (more particularly before starting to drive the cleaning roller 47 in the normal direction), so that the tension of the conveying belt 38 at the detection position P1 is increased.

If the concentration detection of the patch P is ended, the operation branches to Yes at S140. At S150, the cleaning roller 47 is driven in a reverse direction (direction of the arrow F2 in FIG. 3) to clean the formed patch P. The driving in the reverse direction is performed until the cleaning of the patch P is ended (i.e., the trailing edge of the patch P passes the contact position P2 of the cleaning roller 47). If the cleaning roller 47 is driven in the reverse direction, the resistance force of the cleaning roller 47 against the circulating movement of the conveying belt 38 is increased again, while the action of scraping away residue such as the toner on the conveying belt 38 is strengthened to increase the cleaning power. At this time, the tension of the conveying belt 38 at the detection position P1 is decreased in accordance with an increased resistance force of the cleaning roller 47. However, in this case, since the concentration detection of the sensor 100 for the patch P is ended, the detection precision is not affected.

If the cleaning of the patch P is ended, the operation branches to Yes at S160, whereby the cleaning roller 47 is driven in the normal direction. The driving in the normal direction is a preparation process for detecting the next patch P. If the next patch P does not exist, the operation branches to Yes at S180 to go to the patch concentration measurement end process at S190. If the next patch P exists, the operation branches to No at S180, whereby the process from S120 to S170 is repeated again. Since the cleaning roller 47 starts to be driven in the normal direction at S170, if the next patch P exists, the resistance force of the cleaning roller 47 against the circulating movement of the conveying belt 38 is decreased as compared with before detection (before starting to drive the cleaning roller 47 in the normal direction) when the concentration of the next patch P is detected by the sensor 100, so that the tension of the conveying belt 38 at the detection position P1 is increased. Accordingly, the concentration detection of the next patch P is made at high precision.

The patch concentration measurement end process at S190 involves stopping the photosensitive drum 25, the developing roller 27, the cleaning roller 47 and the conveying belt 38 which start to be driven in the patch concentration measurement start process at S110. They may be stopped in sequence or in parallel.

Figure 7:
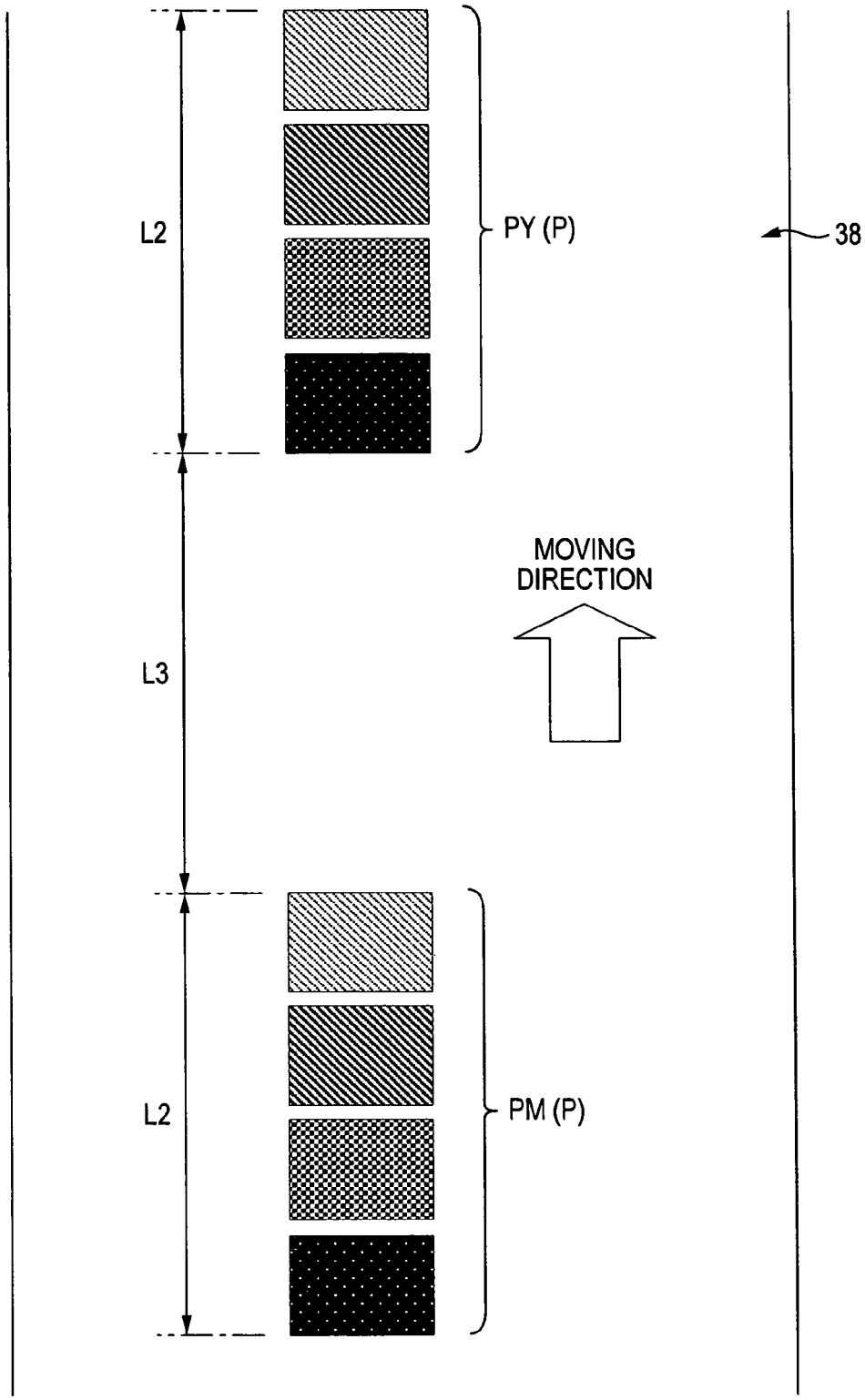
FIG. 7 is an explanatory view for explaining an example of forming a plurality of patches on the conveying belt.

FIG. 7 is an explanatory view for explaining an example of forming a plurality of patches P in the image forming unit 5. In the example of FIG. 7, after the patches PY (P) for yellow are formed, the patches PM(P) for magenta are formed.

In this aspect, the patches P (pattern images) having the length L2 shorter than the length L1 between the detection position P1 (FIG. 3) and the cleaning position P2 (FIG. 3) in the circulating direction of the conveying belt 38 are formed on the belt, as shown in FIG. 7. The cleaning operation of the cleaning roller 47 is started after the concentration detection of the patches P by the sensor 100 is completed and before the top of the patches P arrives at the cleaning position P2 (more particularly the driving of the cleaning roller 47 in the reverse direction is started). Accordingly, the tension at the detection position P1 can be increased in making the detection with the sensor 100, and the detection of the patches P is completed before cleaning the patches P. Accordingly, the configuration in which the detection is made at high precision and the cleaning is performed immediately after detection can be adopted suitably.

Also, when the plurality of patches P are formed in the image forming unit 5, the preceding patches PY and the succeeding patches PM are spaced by a clearance L3 larger than the length L1 between the detection position P1 and the cleaning position P2, and formed on the conveying belt 38, as shown in FIG. 7. Accordingly, the next patches PM are not detected during the cleaning of the patches PY, whereby the concentration detection and the cleaning of the patches P can be performed excellently, when the plurality of patches are formed, as shown in FIG. 7.

In this aspect, since the image forming unit 5 forms the patches P separately, spaced by the clearance L3 larger than the length L1 (FIG. 3) between the detection position P1 and the cleaning position P2, the cleaning and the detection are not performed at the same time even if the patches are arranged consecutively and lengthened. Though in this example the patches PY for yellow and the patches PM for magenta having the marks at the gradations of 20%, 40%, 60% and 80% are formed separately, the patches for one color may be separated into a plurality by the above method. For example, when ten marks are formed at a step of 10% from 10% to 100%, they may be divided into the patches from 10% to 50% and the patches from 60% to 100%. In this case, they are spaced by the clearance L3 larger than the length L1 (FIG. 3) between the detection position P1 and the cleaning position P2 and formed. In this manner, the area occupied by each mark can be kept larger, whereby the detection at high precision can be made. That is, if the marks at more gradations are formed in a narrow area, the area for each mark is smaller, possibly degrading the detection precision, but this problem can be solved using the above method.

Referring to a flowchart of FIG. 8, a belt substrate measurement process will be described below.

Figure 8:
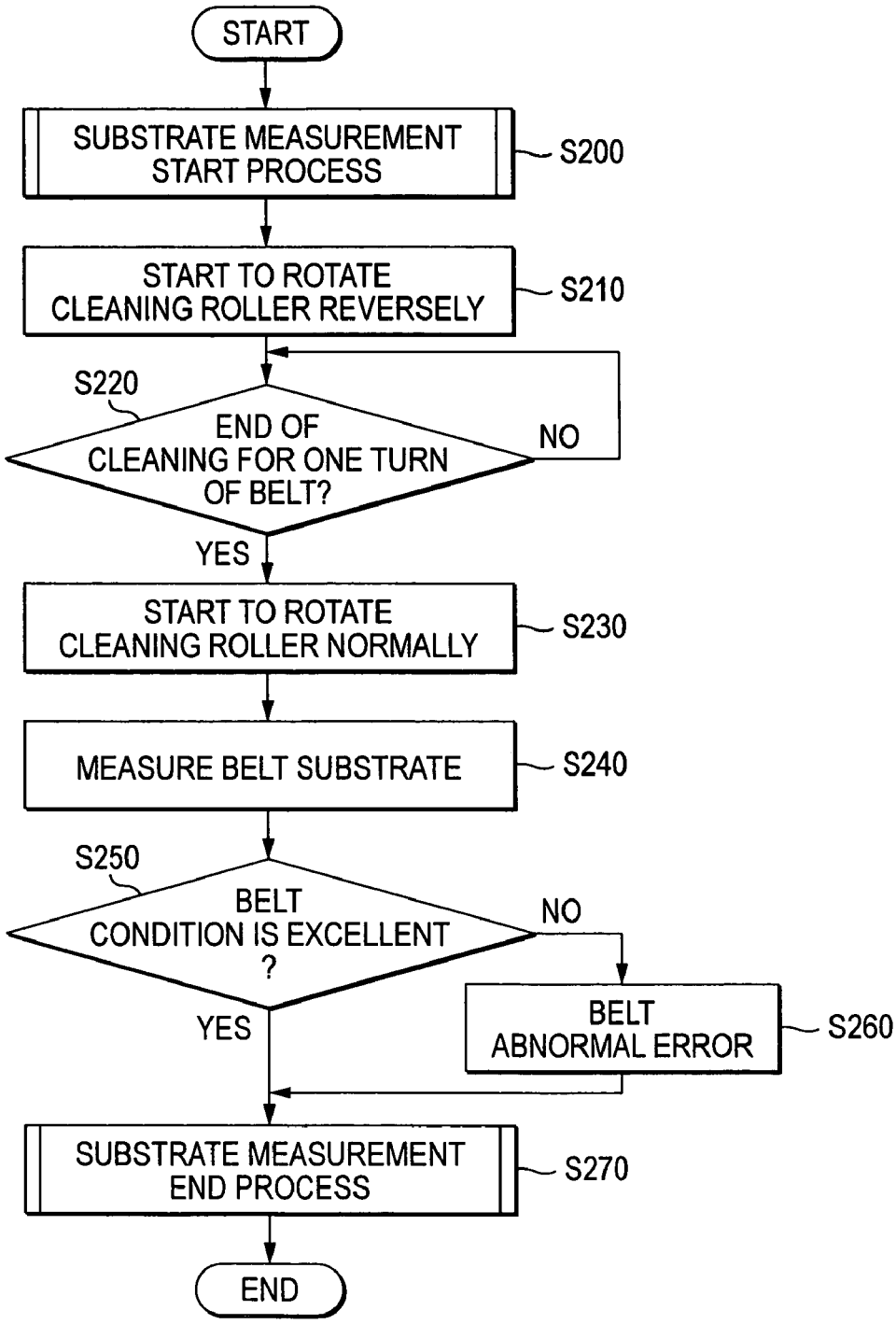
FIG. 8 is a flowchart illustrating the flow of a substrate measurement process.

As shown in FIG. 8, if the belt substrate measurement process is started, a substrate measurement start process is performed at S200. This substrate measurement start process, like the patch concentration measurement start process (S100) of FIG. 5, involves starting to drive the conveying belt 38, the photosensitive drum 25, the developing roller 27, and the cleaning roller 47 in the normal rotation direction. Thereafter, the cleaning roller 47 is driven in the reverse rotation direction at S210. This driving in the reverse rotation direction is performed from the start of the driving in the reverse rotation direction to the end of one turn of the conveying belt 38. If the conveying belt 38 is cleaned for one turn, the operation branches to Yes at S220, whereby the cleaning roller 47 is driven in the normal rotation direction (S230). If the cleaning roller 47 is driven in the normal rotation direction, the resistance force of the cleaning roller 47 against the circulating movement of the conveying belt 38 is decreased as compared with before detection (more particularly before starting to drive the cleaning roller 47 in the normal rotation direction), so that the tension of the conveying belt 38 at the detection position P1 is increased, as described above. In this state, the belt substrate measurement process at S240 is performed. The belt substrate measurement process involves detecting the darkness of the substrate of this belt through sensor 100, in which the increased tension is maintained during this detection process. It is judged at S250 whether or not the belt condition is excellent (more particularly the detected darkness meets the standard). If the belt condition is not excellent (e.g., there is a stain on the belt), an error is reported at S260. After reporting the error, a substrate measurement end process is performed at S270. Also, if the belt condition is judged as excellent at S250, the substrate measurement end process is also performed at S270. The substrate measurement end process at S270, similar to the patch concentration measurement end process (S190) of FIG. 5, involves stopping the photosensitive drum 25, the developing roller 27, the cleaning roller 47 and the conveying belt 38 which are being driven. Thus, in this aspect, as the "detection of the surface state of the belt", the pattern image is not only detected but also the substrate darkness of the conveying belt 38 is detected, whereby the tension of the conveying belt is increased. Though in this aspect the substrate darkness of the conveying belt 38 is detected after the conveying belt 38 is cleaned for one turn, the substrate darkness of the conveying belt 38 may be detected after the conveying belt is cleaned for one or more turns (e.g., two turns).

As described above, in this aspect, when the surface state of the belt is detected by the sensor 100, the tension of the conveying belt 38 at the detection position P1 can be increased to stabilize the conveying belt 38, whereby the surface state of the conveying belt 38 is detected at high precision. Also, the tension of the conveying belt 38 is not always increased, but the tension is controlled to be weakened for a certain period, so that the load on the conveying belt 38 is suppressed, and the elongation or reform of the conveying belt 38 is effectively suppressed.

Since the tension of the conveying belt 38 can be increased when employing the cleaning roller 47, it is unnecessary to provide any special components to increase the tension of the conveying belt 38, whereby the detection at high precision can be made with lower costs.

Also, in detecting the patch, the rotational speed of the cleaning roller 47 in the forward direction for delivering the conveying belt 38 is relatively increased as compared with before detection (more particularly the cleaning roller 47 is driven in the forward direction for delivering the conveying belt 38 from the stopped state (see S100 in FIG. 5), or the cleaning roller 47 is rotated in the forward direction from the inversely rotating state (see S170 in FIG. 5)), so that the resistance force of the cleaning roller 47 against the circulating movement of the conveying belt 38 is decreased. Accordingly, the resistance force of the cleaning roller 47 can be simply decreased without employing the complex mechanism.

In this aspect, the conveying belt 38 is stretched around two rollers to make up two planes 38A and 38B, as shown in FIGS. 1 and 3. The image forming unit 5 is opposed to one plane 38A (one plane). On the other hand, the sensor 100 is opposed to the other plane 38B different from the one plane to which the image forming unit 5 is opposed. That is, the parts making up the image forming unit 5 and the parts making up the sensor 100 are not concentrated near the one plane, but arranged over plural planes efficiently, whereby the configuration is compact.

Figure 9:
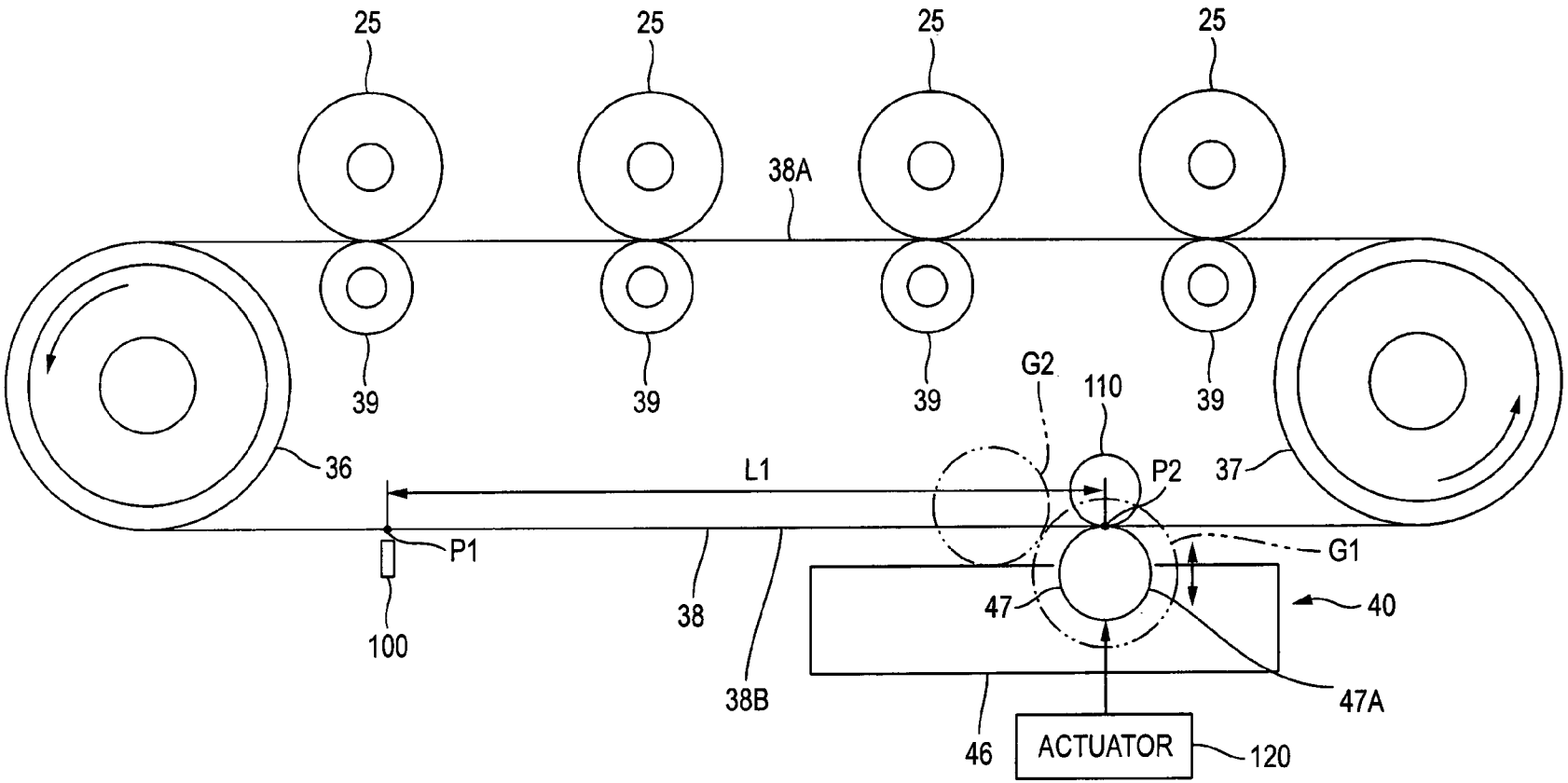
FIG. 9 is an explanatory view for conceptually explaining the configuration near the conveying belt in a laser printer according to another aspect of the present invention.

Referring to FIG. 9, another aspect will be described below.

In the above aspect, the tension of the conveying belt 38 is increased by relatively changing the rotational speed of the cleaning roller 47 in the forward direction. On the other hand, in this aspect, the cleaning roller 47 can be contacted with or not-contacted with the conveying belt 38 to increase the tension of the conveying belt 38. Since the configuration other than the cleaning unit 40 is the same as in the above aspect, the detailed explanation of the configuration other than the cleaning unit 40 is omitted.

As shown in FIG. 9, in this aspect, the cleaning roller 47 can be contacted with or not-contacted with the conveying belt 38. Specifically, an actuator 120 for linearly driving the cleaning roller 47 is provided, and the cleaning roller 47 is displaced between a contact position as shown in FIG. 9 and an out-of-contact position not-contacted with the contact position by the driving of this actuator 120. The actuator 120 linearly displaces the cleaning roller 47 based on an electric signal, and is a solenoid or a stepping motor, for example. When the stepping motor is employed, it is suitable to transform the rotation of the motor into linear motion using a transformation mechanism (e.g., transformation mechanism using a cam).

One example of a driving configuration is shown in FIG. 9. In this configuration, a gear G1 is secured to the rotation shaft of the cleaning roller 47, in which when the cleaning roller 47 is at the contact position, this gear G1 receives a motive force from a driving gear G2, while when the cleaning roller 47 is at the out-of-contact position, the gear G1 is not-contacted with the driving gear G2 to shut off the motive force. In the case of this configuration, the resistance force can be decreased as compared with that before detection by displacing the cleaning roller 47 from a contact state contacted with the conveying belt 38 to an out-of-contact state not-contacted with the belt. That is, the cleaning roller 47 is driven in the reverse rotation direction, in which when the cleaning is performed, the cleaning roller 47 rotating in the reverse direction is contacted with the belt to perform the cleaning, as shown in FIG. 9. On the other hand, when the pattern image or the belt substrate is detected by the sensor 100, the actuator 120 is driven to not-contacted with the cleaning roller 47 away from the conveying belt 38, whereby the resistance force of the cleaning roller 47 against the circulating movement of the conveying belt 38 can be decreased.

The present invention is not limited to the aspects as described above and shown in the drawings, but the following aspects may also fall within the technical scope of the invention, and various modifications may be made without departing from the spirit or scope of the invention.

While the tension of the belt is increased by the cleaning roller 47 in the above aspects, a tension increase unit may be implemented by the drive roller 36. For example, the sensor 100 is disposed opposite to a portion from the drive roller 36 to the tension roller 37 in the circulating direction of the conveying belt 38, as in the above aspects, and the drive roller 36 is controlled so that the rotational speed of the drive roller 36 is decreased from the first rotational speed before detection to the second rotational speed smaller than the first rotational speed, thereby increasing the tension of the conveying belt 38 as compared with before detection. As an example, the rotational speed may be decreased by controlling the current value to the main motor 96 under the control of the CPU 91, in which the CPU 91, the main motor 96 and the drive roller 36 corresponds to the tension increase unit. In this case, the configuration for increasing the tension of the belt can be simply implemented without providing a special component such as the tension increase unit, whereby the detection can be made at high precision with lower costs.

The "image forming apparatus" of the invention is not only the printing apparatus such as the printer (e.g., laser printer) but also may be a facsimile apparatus or a multi-function apparatus having the print function and the scanner function. Also, it is not limited to the tandem type including an image carrier for each developing roller 27, as in the above aspects, but may be a transfer type in which each developing roller forms the developer image on the common image carrier, an intermediate transfer type, or a single path type.

The belt as defined in the present invention is not limited to the conveying belt as in the above aspects. For example, when the image forming apparatus is constructed as a multiple developing type apparatus (single path type or multi-rotation type), the "photosensitive belt" on which the electrostatic latent image is formed by exposure may be the "belt" of the invention. Also, when the image forming apparatus is constructed as an intermediate transfer type apparatus, an "intermediate transfer belt" filling the intermediate role to transfer the developer image carried on the photosensitive drum onto the recording medium may be the "belt" of the invention.

While in the above aspects, the resistance force is adjusted by controlling the rotational speed or the contact or not-contact of the cleaning roller, the resistance force may be adjusted by controlling the contact force of the cleaning member with the belt. For example, the resistance force may be adjusted by strongly pressing the cleaning member against the belt during the cleaning, but weakly pressing it at the time of detection.

While in the above aspects, the cleaning roller is exemplified as the cleaning member, the cleaning member may have the ability of wiping or scraping away the foreign matter on the belt (e.g., cleaning blade constructed like a blade). When the cleaning blade is employed, the resistance force may be adjusted by contact or not-contact of the cleaning blade, or the resistance force may be adjusted by controlling the contact force of the cleaning blade with the belt.

While in the above aspects, the cleaning member is constituted by the cylindrical cleaning roller, the cleaning member may be constituted of a rotatable brush member.

While in the above aspect, the rotational speed of the cleaning roller 47 in the forward direction is relatively increased by rotating the cleaning roller 47 in the normal rotation direction (forward direction) from the stopped state, or by rotating it from the reverse rotation direction to the normal rotation direction, the following method may be adopted for decreasing the resistance force by relatively increasing the rotational speed of the cleaning roller 47 in the forward direction. For example, the resistance force may be decreased by changing the cleaning roller from a predetermined rotational speed (first forward rotational speed) to a second forward rotational speed greater than the first rotational speed in a state where the cleaning roller 47 is rotated in the normal rotation direction (forward direction) for delivering the conveying belt 38. Also, the resistance force may be decreased by changing the cleaning roller from a predetermined rotational speed (first reverse rotational speed) to the second reverse rotational speed smaller than the first rotational speed in a state where the cleaning roller 47 is rotated in a reverse direction to the normal rotation direction (forward direction) for delivering the conveying belt 38.

While in the above aspects the patch for concentration measurement is exemplified as the "pattern image", the patch is not limited to concentration measurement. For example, the patch may be a mark for measuring the movement amount of the belt, or a registration mark formed to detect the image formed position for each color.

[FIG. 2]
5 Image forming unit
94 Network I/F
95 Control unit
96 Main motor
97 Scanner motor
98 Operation unit
99 Display unit
100 Sensor
M1 Motor
[FIG. 3]
1 Color laser printer (image forming apparatus)
5 Image forming unit
36 Drive roller
37 Tension roller
38 Conveying belt (belt)
38A One plane
38B Another plane
47 Cleaning roller (cleaning member, roller member, tension increase unit)
91 CPU (tension increase unit)
100 Sensor (detection unit)
M1 Motor (tension increase unit)
P1 Detection position
P2 Cleaning position
[FIG. 4]
S10 Normal image forming start process
S20 Paper feed operation (pickup operation)
S30 Image forming operation
S40 Is paper ejection detected?
S50 Paper jam error
S60 Normal image forming end process
[FIG. 5]
S100 Patch concentration measurement start process
S110 Image forming process (patch formation)
S120 Patch concentration sensor position?
S130 Measure patch concentration.
S140 End of patch detection?
S150 Start to rotate cleaning roller reversely.
S160 End of patch cleaning?
S170 Start to rotate cleaning roller normally.
S180 Is there no next patch?
S190 Patch concentration measurement end process
[FIG. 8]
S200 Substrate measurement start process
S210 Start to rotate cleaning roller reversely.
S220 End of cleaning for one turn of belt?
S230 Start to rotate cleaning roller normally.
S240 Measure belt substrate.
S250 Is belt condition excellent?
S260 Belt abnormal error
S270 Substrate measurement end process
[FIG. 9]
120 Actuator

What is claimed is:

1. An image forming apparatus comprising:
an image forming unit that forms at least a pattern image;
an annular belt that moves circularly and carries the pattern image formed by the image forming unit;
a detection unit that detects a state of a surface of the belt, including the pattern image carried on the belt;
a tension increase unit that increases a tension of the belt, at a detection position where the detection unit detects the pattern image, each time when the detection unit detects the pattern image, as compared with the tension of the belt at the detection position before the detection unit detects the pattern image;
a drive roller that drives the belt; and
a cleaning member that cleans the belt, wherein:
the detection unit is opposed to the belt between a support position where the belt is supported on the drive roller and a cleaning position where the belt is contacted with the cleaning member, in a circulating direction of the belt; and
the tension increase unit controls the cleaning member to decrease a resistance force of the cleaning member in the circulating movement of the belt as compared with the resistance force of the cleaning member before the detection unit detects the pattern image.

2. The image forming apparatus according to claim 1, wherein:
the cleaning member can be contacted with or not-contacted with the belt; and
the tension increase unit decreases the resistance force, as compared with the resistance force before the detection unit detects the pattern image, by displacing the cleaning member from a contact state to a not-contact state.

3. The image forming apparatus according to claim 1, wherein:
the cleaning member is a roller member that contacts the belt; and
the tension increase unit drives the roller member to relatively increase a rotational speed of the roller member in a forward direction for delivering the belt, as compared with the rotational speed before the detection unit detects the pattern image, thereby decreasing the resistance force.

4. The image forming apparatus according to claim 1, wherein
the image forming unit forms on the belt the pattern image having a length shorter than a length between the detection position and the cleaning position in the circulating direction of the belt; and the cleaning member starts cleaning the belt after the detection unit has completed detecting the pattern image and before the pattern image arrives at the cleaning position.

5. The image forming apparatus according to claim 1, wherein:

the image forming unit forms a preceding pattern image and a succeeding pattern image on the belt with a larger clearance than a length between the detection position and the cleaning position in the circulating direction of the belt.

6. The image forming apparatus according to claim 1, wherein:

the image forming unit forms a plurality of pattern images on the belt by separating the plurality of pattern images with a larger clearance than a length between the detection position and the cleaning position in the circulating direction of the belt.

7. The image forming apparatus according to claim 1, further comprising a drive roller that drives the belt; and a tension roller following the belt driven by the drive roller, wherein:

the detection unit is configured to be opposed to a portion from the drive roller to the tension roller in the circulating direction of the belt; and the tension increase unit controls the drive roller to reduce a rotational speed of the drive roller from a first rotational speed before the detection unit detects the pattern image to a second rotational speed smaller than the first rotational speed, thereby increasing the tension of the belt as compared with the tension of the belt before the detection unit detects the pattern image.

8. The image forming apparatus according to claim 1, wherein:

the belt is stretched around a plurality of rollers to form a plurality of planes; and the detection unit is opposed to the belt located on a first plane different from a second plane to which the image forming unit opposes.

9. An image forming apparatus comprising:

an image forming unit that forms at least a pattern image;

an annular belt that moves circularly and carries the pattern image formed by the image forming unit;

a detection unit that detects a state of a surface of the belt, including the pattern image carried on the belt;

a tension increase unit that increases a tension of the belt, at a detection position where the detection unit detects the pattern image, each time when the detection unit detects the pattern image, as compared with the tension of the belt at the detection position before the detection unit detects the pattern image;

a drive roller that drives the belt; and a tension roller following the belt driven by the drive roller, wherein:

the detection unit is configured to be opposed to a portion from the drive roller to the tension roller in the circulating direction of the belt; and the tension increase unit controls the drive roller to reduce a rotational speed of the drive roller from a first rotational speed before the detection unit detects the pattern image to a second rotational speed smaller than the first rotational speed, thereby increasing the tension of the belt as compared with the tension of the belt before the detection unit detects the pattern image.

10. The image forming apparatus according to claim 9, wherein:

the belt is stretched around a plurality of rollers to form a plurality of planes; and the detection unit is opposed to the belt located on a first plane different from a second plane to which the image forming unit opposes.

* * * * *